US006419138B1

(12) United States Patent
Takahashi et al.

(10) Patent No.: US 6,419,138 B1
(45) Date of Patent: Jul. 16, 2002

(54) DEVICE CONVEYING A CARRIER TAPE USED FOR ELECTRONIC COMPONENTS

(75) Inventors: Koichi Takahashi; Shigeru Shiozawa; Koji Sato, all of Tokyo (JP)

(73) Assignee: Kabushiki Kaisha Shinkawa, Tokyo (JP)

( * ) Notice: Subject to any disclaimer, the term of this patent is extended or adjusted under 35 U.S.C. 154(b) by 0 days.

(21) Appl. No.: 09/539,794

(22) Filed: Mar. 31, 2000

(30) Foreign Application Priority Data

Mar. 31, 1999 (JP) ..... 11-093182

(51) Int. Cl.[7] ..... B65H 23/34
(52) U.S. Cl. ..... 226/88; 226/185
(58) Field of Search ..... 226/88, 184, 186

(56) References Cited

U.S. PATENT DOCUMENTS 1,114,478 A * 10/1914 Ibarra ..... 226/184 X
2,266,362 A * 12/1941 Forster ..... 226/88
2,603,343 A * 7/1952 Payne ..... 226/186 X
3,072,309 A * 1/1963 Hill ..... 226/88
3,132,785 A * 5/1964 Kunz ..... 226/186 X
3,282,486 A * 11/1966 Moss ..... 226/88 X
3,847,708 A * 11/1974 Takahashi et al. ..... 226/88 X
3,929,327 A * 12/1975 Olson ..... 226/184 X
4,534,499 A * 8/1985 Cox et al. ..... 226/184

* cited by examiner

*Primary Examiner*—Michael R. Mansen
(74) *Attorney, Agent, or Firm*—Koda & Androlia

(57) ABSTRACT

A device for conveying a carrier tape by holding both sides with pressing rollers and drive rollers that rotate in opposite directions. The drive rollers have large-diameter portions and small-diameter portions so that the large-diameter portions are formed on inner sides of the circumferential surfaces of the drive rollers and the small-diameter portions are formed on outer sides thereof; and the pressing rollers have small-diameter portions and large-diameter portions so that the small-diameter portions are formed on inner sides of the circumferential surfaces of the pressing rollers and the large-diameter portions are formed on outer sides thereof. Both side edges of the carrier tape are pressure-held and conveyed by the pressing rollers and drive rollers with the large-diameter portions of the pressing rollers pressing the side edges onto the small-diameter portions of the drive rollers, thus curving the carrier tape in its width direction and preventing sagging of the carrier tape across the width.

5 Claims, 6 Drawing Sheets

DEVICE CONVEYING A CARRIER TAPE USED FOR ELECTRONIC COMPONENTS

BACKGROUND OF THE INVENTION

1. Field of the Invention

The present invention relates to a carrier tape conveying device which is used in assembly processes of electronic components such as semiconductor elements, etc., and more particularly to a conveying device that conveys an electronic component carrier tape constructed from a soft, heat-resistant flexible material such as a synthetic resin (referred to as a "resin film") in the direction of length of the carrier tape.

2. Prior Art

The carrier tape system widely used in semiconductor element assembly processes uses a carrier tape in which a conductive layer is formed on appropriate portions of the top surface of a band-form film made of a synthetic resin. In this system, various types of assembly processes are performed by separate working devices for the respective working processes. For instance, an arrangement and bonding of numerous silicon chips to the top surface or undersurface of the carrier tape (die bonding), a connection of the surface electrodes of the silicon chips to a conductive layer by conductive wires (a wire bonding method), and a sealing of these parts with a synthetic resin (packaging) are performed.

FIG. 6 shows one of the conventionally used carrier tape conveying devices used in such carrier tape systems.

In this carrier tape conveying device, pressing rollers 75 are disposed on the top surface sides of the side edge portions of the carrier tape 2, and drive rollers 77 are disposed on the undersurface sides of these side edge portions. The rotating shafts of the pressing rollers 75 are supported so that they rotate on pressing frames 29 that are constantly driven downward. The rotating shafts of the drive rollers 77 are connected to motors 41.

In this construction, both side edge portions of the carrier tape 2 are pressure-held between the pressing rollers 75 and drive rollers 77 as a result of the driving force of the pressing frames 29. The carrier tape 2 is conveyed in the direction of its own length (i.e. in the direction perpendicular to the surface of the drawing sheet) by the driving of the motors 41. When a silicon chip 70 bonded to the undersurface of the conveyed carrier tape 2 stops at a specified working position, a jig 24 containing a heater used for preparatory heating is raised. As a result, the silicon chip 70 on the undersurface of the carrier tape 2 is received in a retaining hole 26 formed in the jig 24, and the upper surface of the carrier tape 2 is pressed by a clamp (not shown). Then, the carrier tape 2 and silicon chip 70 in this attitude are subjected to working such as wire bonding, etc. from above.

However, the carrier tape 2 is flexible and is softened by preparatory heating by the heater. Accordingly, a sag in the direction of width as indicated by the one-dot chain line 72 in FIG. 6 is generated in the carrier tape 2 by the weight of the silicon chips 70 bonded to the carrier tape 2. In cases where conveying is continued in this state, the silicon chips 70 may collide with the waiting jig 24 if the sagging is severe, and the silicon chips 70 are subjected to impacts and vibrations. Furthermore, in the case of such collisions or in cases where the extraction of the silicon chips 70 from the jig 24 is insufficient, the carrier tape 2 may be pulled by an excessive force, so that stretching or shifting of the holding position occurs in the carrier tape 2, causing a drop in conveying precision and working precision.

SUMMARY OF THE INVENTION

Accordingly, the object of the present invention is to provide a conveying device that is able to prevent sagging of the carrier tape across the width thereof during conveying before such sagging occurs.

The object is accomplished by a unique structure for a device for conveying a carrier tape for an electronic component in which the side edge portions of a carrier tape are pressure-held from its upper and under surfaces by a pair of rollers rotating in opposite directions so as to convey the tape in the direction of length thereof; and in the present invention, a supporting member which protrudes upward with respect to the pressure-holding position of the rollers is provided on the center side of the carrier tape with respect to the direction of width of the carrier tape in the pressure-holding positions of the rollers, so that the carrier tape is held by the pair of rollers and supporting member while being elastically deformed so as to allow its own recovery from the deformed state.

In this structure, the supporting member which protrudes upward in the pressure-holding positions of the pair of rollers (that pressure-hold the carrier tape) is installed further toward the center of the carrier tape with respect to the direction of width of the carrier tape. Accordingly, when the rollers apply a pressure to the side edge portions of the carrier tape, the portion of the carrier tape that is near the center of the carrier tape with respect to its width direction is lifted upward in response to this pressure with the contact points between the carrier tape and the supporting member acting as fulcrums. Furthermore, since the rollers hold the carrier tape while causing an elastic deformation thereof, the holding force of the rollers is reinforced by the recovery force of the carrier tape, and slipping between the respective rollers and the carrier tape is prevented. Sagging of the carrier tape across the width of the carrier tape can thus be prevented in advance.

Furthermore, since the rollers and the supporting member merely cause an elastic deformation of the carrier tape and do not cause plastic deformation of the carrier tape, the carrier tape recovers to its original flat shape after passing through the pressure-holding or the rollers. Accordingly, the original shape of the carrier tape can be maintained without any folds being formed in the carrier tape, and there is no danger of a drop in the conveying precision or working precision that would be caused by plastic deformation of the carrier tape.

The above-described pair of rollers comprises a first roller and a second roller. The first roller has a large-diameter portion and a small-diameter portion. The large-diameter portion is formed on the side of the roller that is located further toward the center of the carrier tape with respect to the width of the carrier tape, and the small-diameter portion is formed on the side of the roller that is located further toward the outer edge of the carrier tape. The outer circumferential surface of the second roller faces the outer circumferential surface of the small-diameter portion of the first roller. The large-diameter portion of the first roller constitutes the supporting member.

Accordingly, the supporting member is formed as an integral part to the first roller. Thus, the structure is simpler than in cases where the roller and supporting member are formed as separate parts. Furthermore, regardless of the assembly precision of the rollers, the difference in height positions between the outer circumferential surface of the small-diameter portion of the first roller (which is the pressure-holding position of the side edge portion of the carrier tape) and the outer circumferential surface of the large-diameter portion of the first roller (which is the holding position of the center side of the carrier tape) can be accurately maintained.

Furthermore, a feeding movement of the carrier tape is imparted by the first roller using its small-diameter portion (which constitutes the pressure-holding position) and its large-diameter portion (which constitutes the supporting member). Here, however, the small-diameter portion and large-diameter portion are integral and rotate together; accordingly, the feeding movement created by the large-diameter portion is greater than the feeding movement created by the small-diameter portion. In other words, the feeding movement of the center side of the carrier tape is greater than the feeding movement of the side edge portion of the carrier tape. Accordingly, the carrier tape that passes through the gap between the first roller and second roller is applied with a tension in the direction of the side edge. Thus, sagging of the carrier tape across the width of the carrier tape can be effectively prevented.

In the present invention, the width of the outer circumferential surface of the large-diameter portion of the second roller is formed so as to be equal to or greater than the width of the outer circumferential surface of the large-diameter portion of the first roller.

Accordingly, the contact area of the outer circumferential surface of the large-diameter portion of the second roller with the carrier tape is larger than the contact area of the outer circumferential surface of the large-diameter portion of the first roller. Thus, the carrier tape conforms well to the outer circumferential surface of the second roller, and the carrier tape is strongly held and elastically deformed. Consequently, sagging of the carrier tape in the direction of width of the carrier tape can be further effectively prevented.

Furthermore, the object is further accomplished by another unique structure for a carrier tape conveying device in which each of the side edge portions of a carrier tape is held under pressure from its upper and under surfaces by a pair of rollers that is comprised of first and second rollers rotating in opposite directions so as to covey the tape in the direction of length thereof; and in the present invention,

- the outer circumferential surface of the first roller faces both an outer layer formed on one surface of the carrier tape and an exposed portion of the carrier tape that is located further toward the side edge of the carrier tape than the outer layer,
- the outer circumferential surface of a large-diameter portion of the second roller faces the other side of the exposed portion of the inner layer of the carrier tape, and
- the first and second rollers hold the side edge of the outer layer and the surface of the exposed portion at an equal height along the outer circumferential surface of the first roller while elastically deforming the carrier tape in a recoverable manner.

In this structure, when the carrier tape is pressure-held by the first and second rollers, the side edge of the outer layer of the carrier tape and the surface of the exposed portion of the carrier tape are held at equal height positions along the outer circumferential surface of the first roller while the carrier tape is being elastically deformed against its own recovery force. Accordingly, the carrier tape can be elastically deformed while utilizing the thickness of the outer layer as a spacer. Thus, since the rollers hold the carrier tape while causing elastic deformation of the carrier tape, the holding force of the rollers is reinforced by the recovery force of the carrier tape, and slipping between the respective rollers and the carrier tape is prevented. Furthermore, since the side edge of the outer layer and the surface of the exposed portion are held at equal height positions along the outer circumferential surface of the first roller, the exposed portion of the carrier tape is sufficiently supported on the first roller. Thus, the carrier tape can be held under a strong pressure so that sagging of the carrier tape in the direction of width caused by the slipping of the carrier tape from the rollers can be effectively prevented.

Furthermore, in the present invention, in addition to the above-described structures, pairs of rollers are installed on one side of a working head, which is used to perform a specific work on the carrier tape, so that the rollers are rotated and convey the carrier tape away from the working head; and a resistance means which holds the carrier tape against the moving force of the pairs of rollers is further installed on another side of the working head.

In this structure, the carrier tape is conveyed while a state of tension is maintained in the direction of length between the rollers and the resistance means. In this case, however, waviness or warping of the carrier tape in the direction of width may be generated as a result of local stretching of the carrier tape in the direction of the length. However, the central portion of the carrier tape is constantly lifted; and sagging of the carrier tape in the direction of width can be prevented.

Furthermore, even if local stretching in the direction of length of the carrier tape occurs in areas of the carrier tape located in the vicinity of the rollers, a deformation of the central portion of the carrier tape is prevented.

BRIEF DESCRIPTION OF THE INVENTION

Figure 3A:
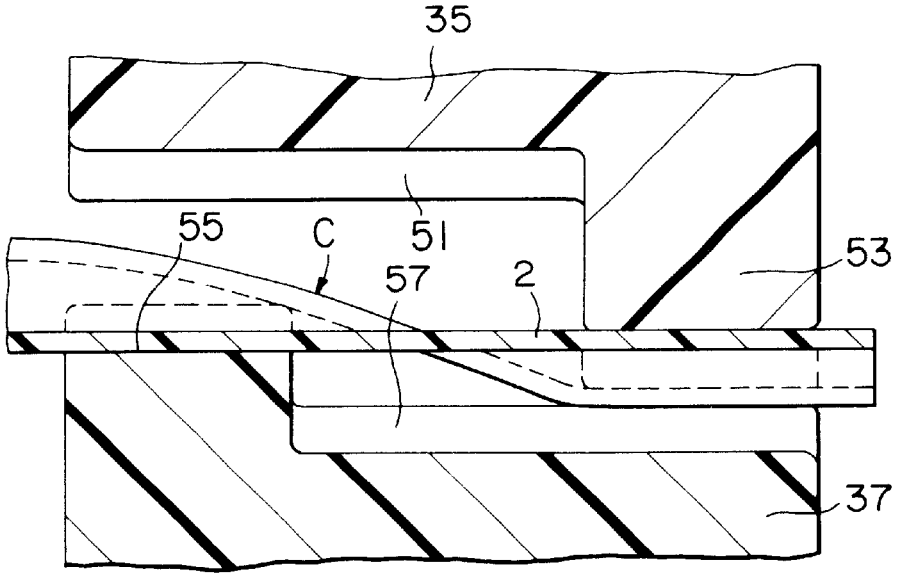
Figure 3B:
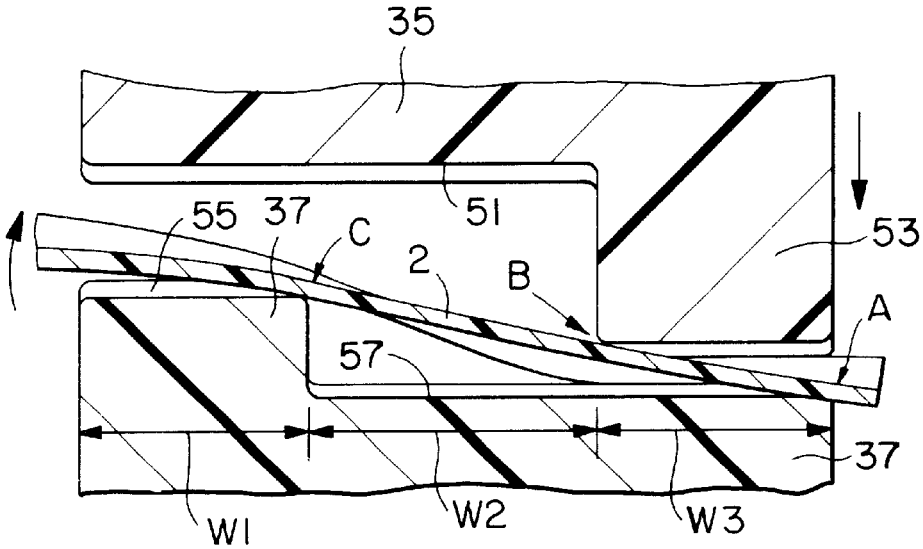
Figure 3C:
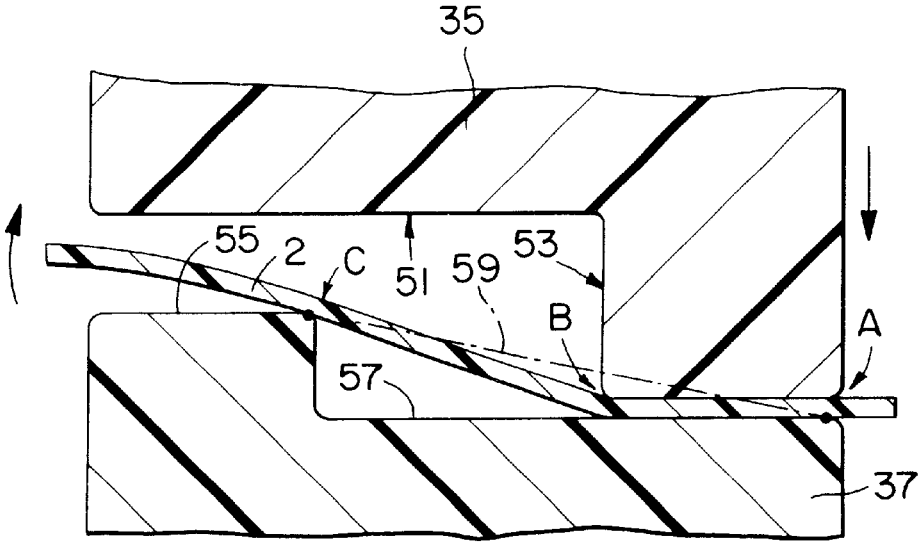
Figure 4A:
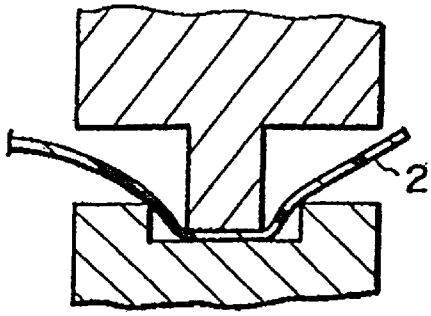
Figure 4B:
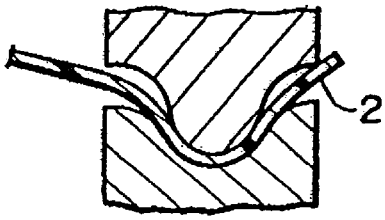
Figure 4C:
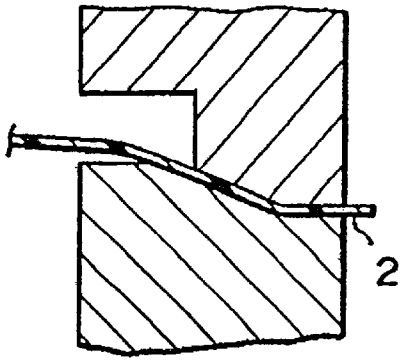
Figure 4D:
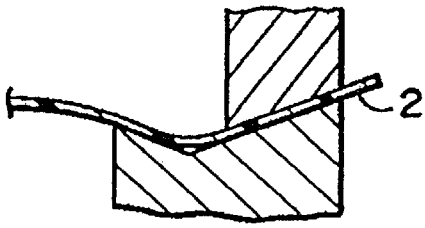
Figure 4E:
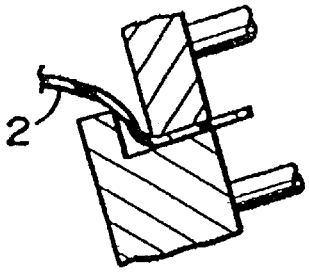
Figure 4F:
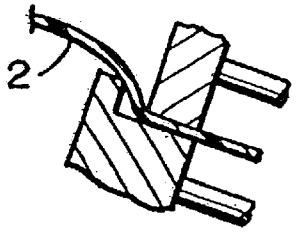
Figure 5A:
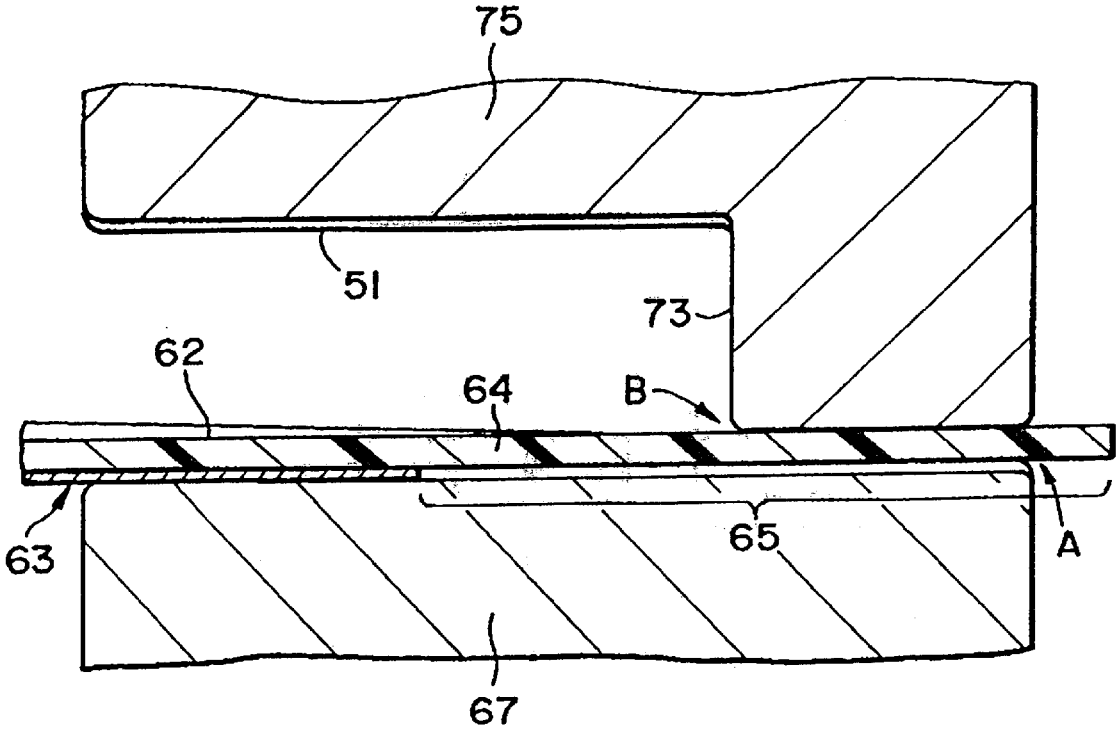
Figure 5B:
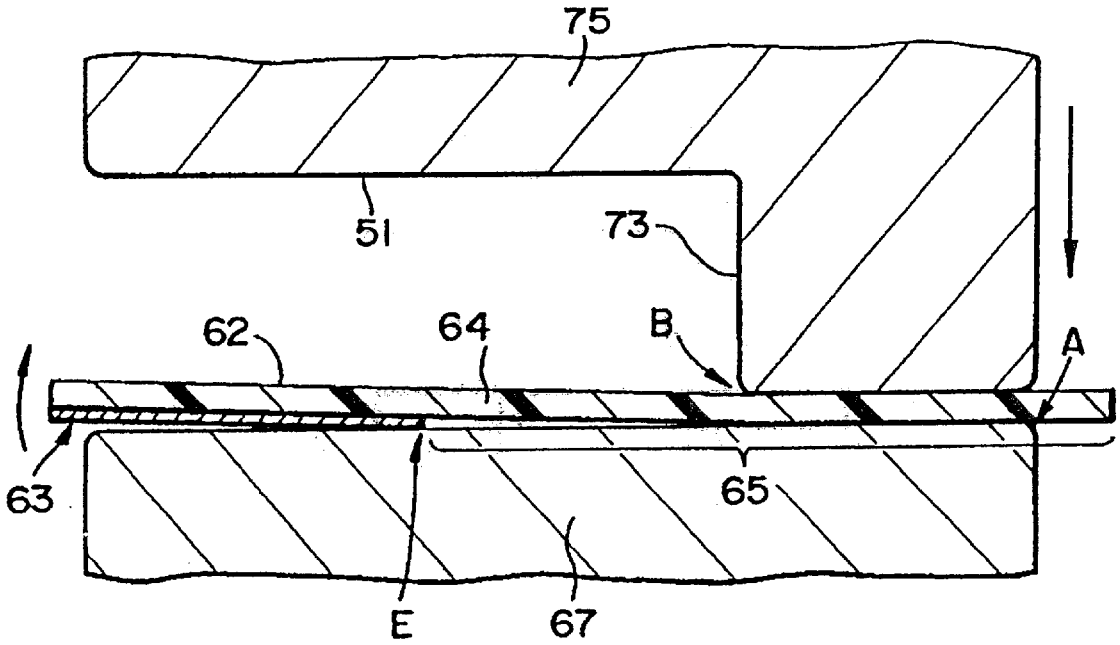
Figure 6:
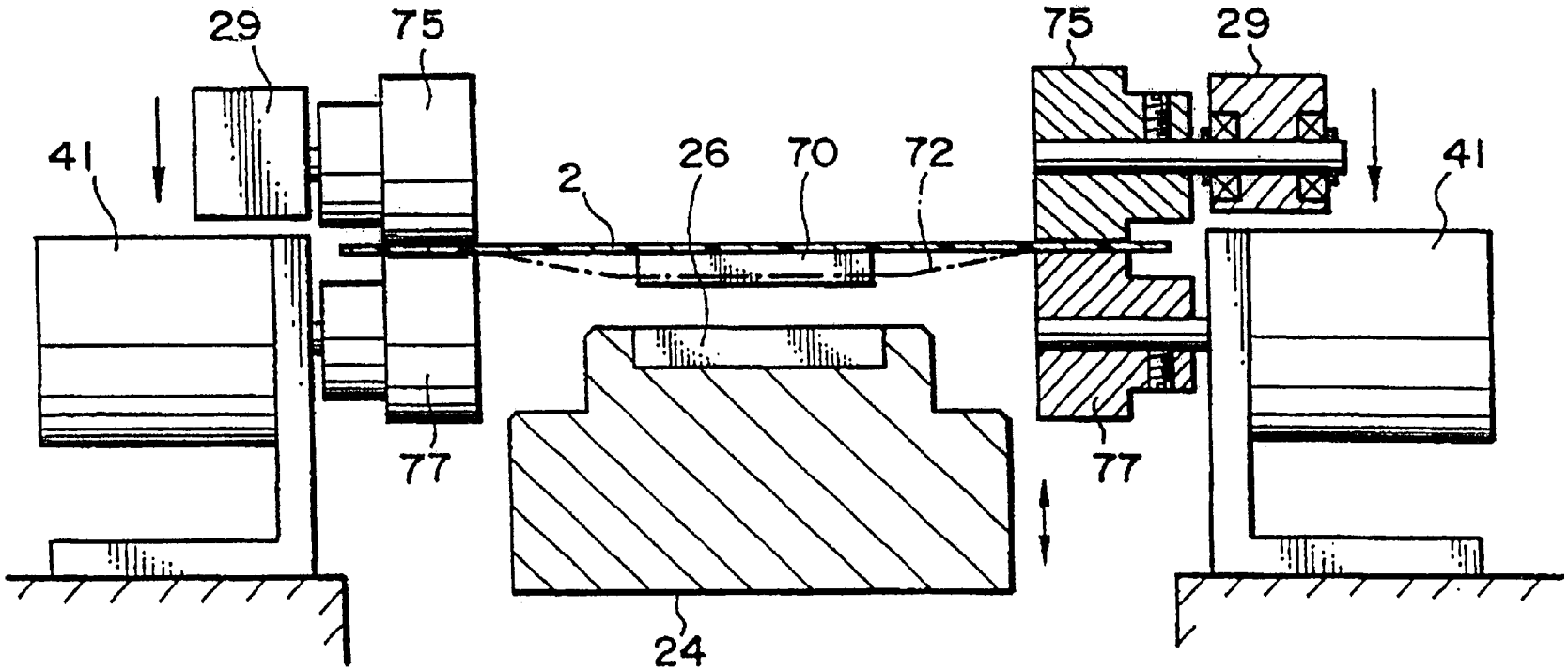
FIG. 6 PRIOR ART

FIGS. 3(*a*) through 3(*c*) are enlarged views of an essential part of a carrier tap conveying device which illustrate the operation of the carrier tape conveying device of the first embodiment of the present invention;

FIGS. 4(*a*) through 4(*f*) are side views of different types of pressing rollers and drive rollers used in the carrier tape conveying device of the present invention;

FIGS. 5(*a*) and 5(*b*) are enlarged views of an essential part of a carrier tape conveying device according to another embodiment of the present invention; and FIG. 6 is a side view of the essential part of a conventional carrier tape conveying device.

DETAILED DESCRIPTION OF THE INVENTION

Below, preferred embodiments of the present invention will be described in detail with reference to the attached drawings.

Figure 2A:
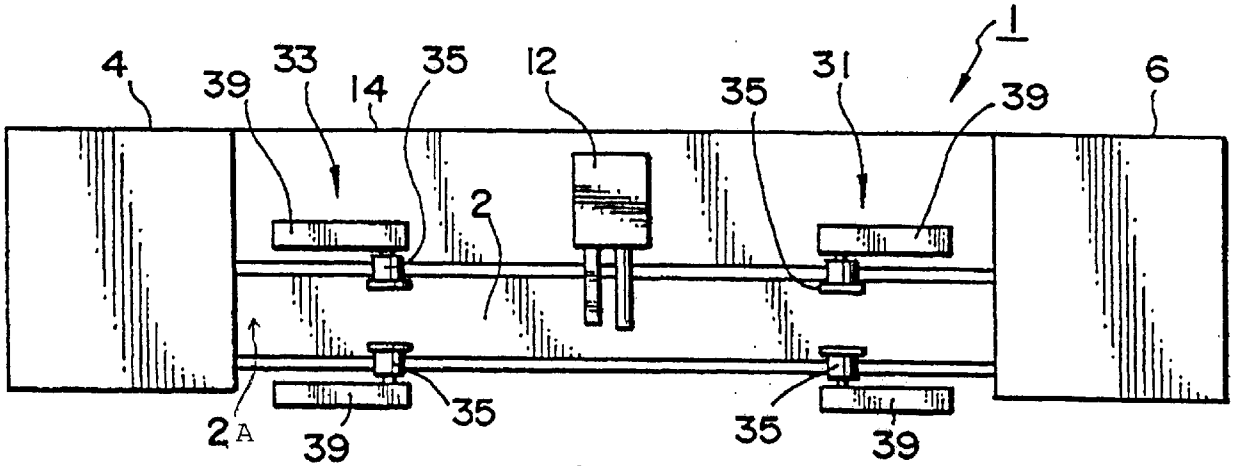
FIG. 2(*a*) is a top view of an electronic component assembling device that uses the first embodiment of the present invention, and FIG. 2(*b*) is a front view thereof.
Figure 2B:
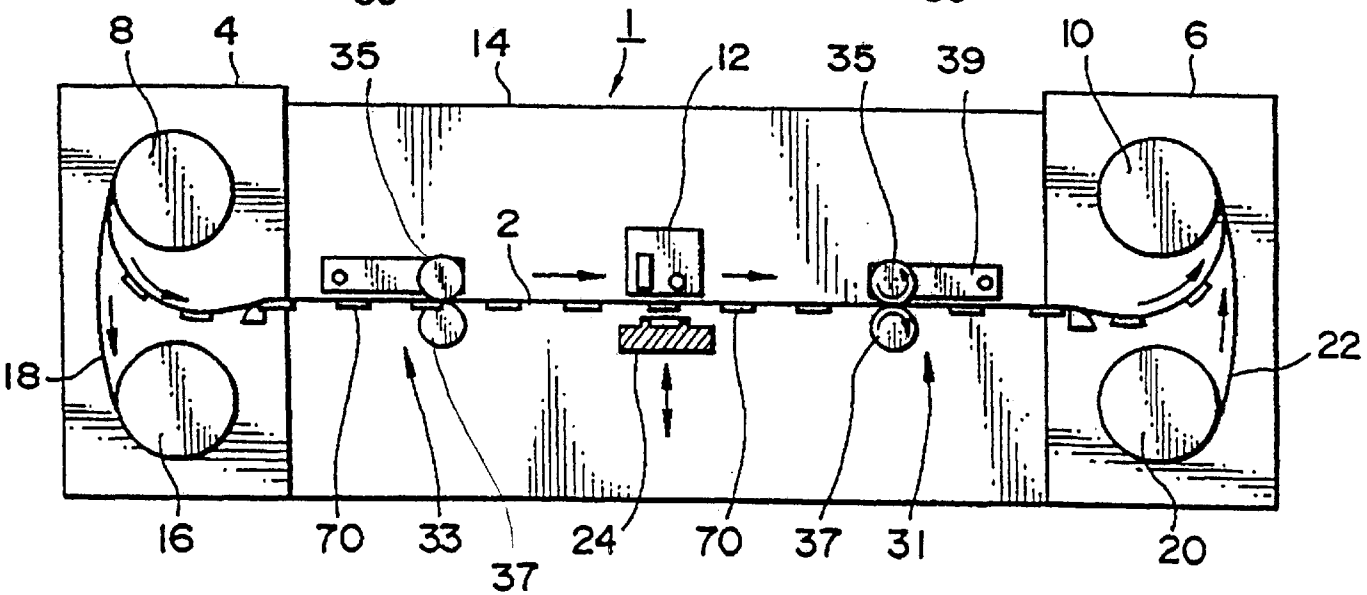

In FIGS. 2(*a*) and 2(*b*), the electronic component assembling device 1 (to which a first embodiment of the present invention is applied) is a wire bonder which connects the surface electrodes of silicon chips 70 to a conductive layer by wires so as to assemble semiconductor elements. This wire bonder comprises a loader unit 4 which accommodates an unworked carrier tape 2 wound on a supply reel 8, an unloader unit 6 in which a worked carrier tape 2 is wound on a take-up reel 10, and a bonding unit 14 equipped with a bonding head 12 that performs the wire bonding process.

In addition to the supply reel 8, a wind-up reel 16 is installed in the loader unit 4. The wind-up reel 16 takes up a protective tape 18 when the carrier tape 2 is unwound from the supply reel 8. Likewise, a feed reel 20 is installed in the unloader unit 6 in addition to the take-up reel 10. The feed reel 20 feeds out a protective tape 22 and applies it to the carrier tape 2 when the carrier tape 2 is wound up on the take-up reel 10. A jig 24 containing a heater (not shown) used for preparatory heating is installed beneath the bonding head 12 of the bonding unit 14. This jig 24 is raised and lowered by a raising-and-lowering mechanism (not shown).

As best seen from FIGS. 2(*a*) and 2(*b*), a pulling section 31 and feed-out section 33 are respectively installed on both sides (or on the left and right side in the drawing) of the bonding head 12. Both the pulling section 31 and feed-out section 33 have the same construction; and they comprise pressing rollers 35 and drive rollers 37. More specifically, as seen from FIG. 2(*b*), a pair of the pressing roller 35 and drive roller 37 are vertically disposed; and this pair of rollers 35 and 37 is, as seen from FIG. 2(*a*), provided so as to be located on either side of the carrier tape 2 or the tape conveying path 2A. The pressing rollers or upper rollers 35 are installed, as second rollers, above the top surface of the carrier tape 2; and the drive rollers or lower rollers 37 are installed, as first rollers, underneath the carrier tape 2.

Figure 1:
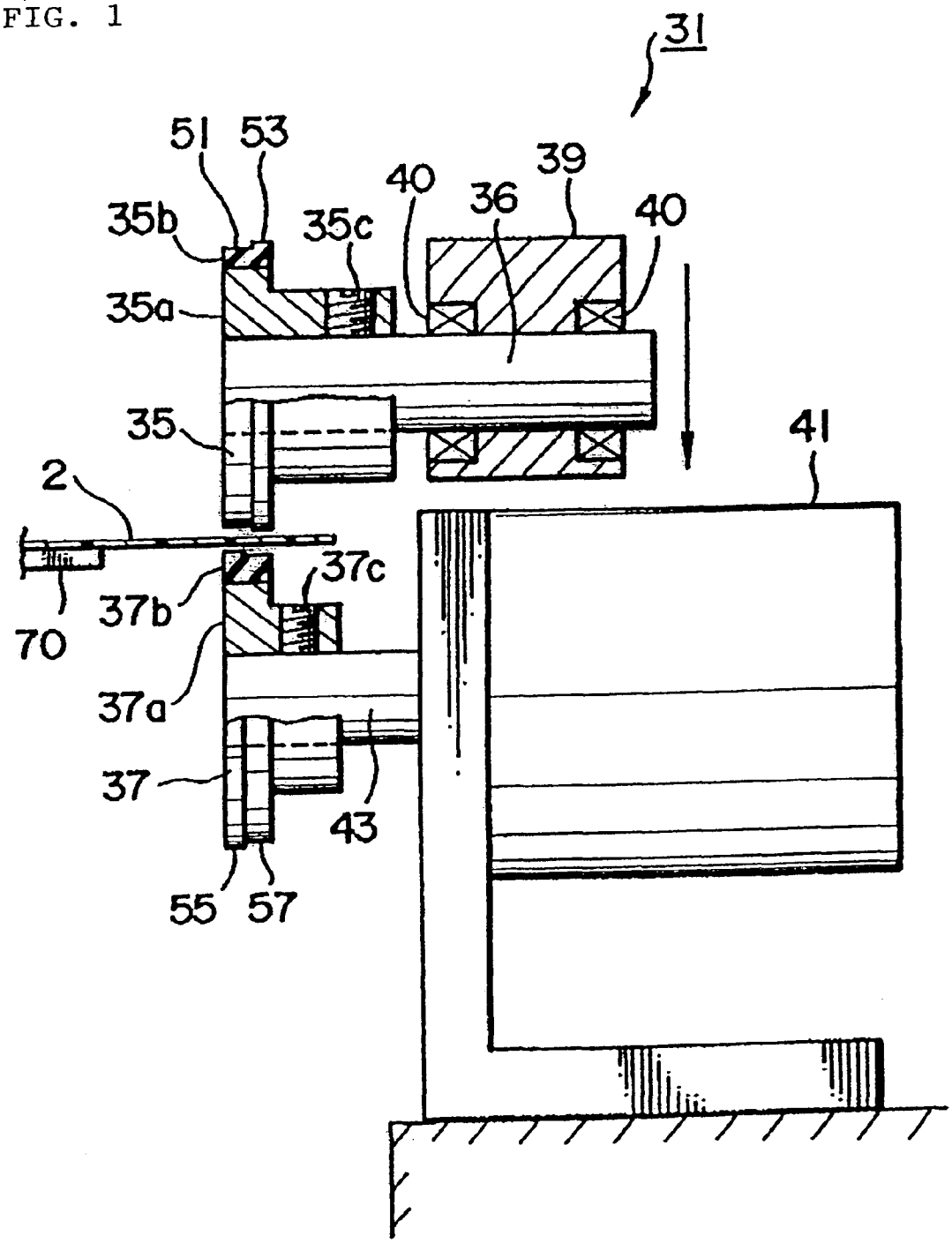
FIG. 1 is a side view of the essential part of a carrier tape conveying device according to the first embodiment of the present invention.

FIG. 1 shows one pair of pressing roller 35 and drive roller 37 of the pulling section 31 that forms a roller assembly.

As seen from FIG. 1, the pressing roller 35 is fastened to a rotating shaft 36 by a screw 35*c* so that the rotating axis thereof is perpendicular to the direction in which the carrier tape 2 is conveyed, and the rotating shaft 36 is rotatably supported via bearings 40 on a pressing frame 39 which is constantly driven downward by a spring (not shown). The drive roller 37 is fastened to the rotating shafts 43 of a motor 41 by screws 37*c* so that the rotating axis of the drive roller 37 is perpendicular to the direction in which the carrier tape 2 is conveyed.

The carrier tape 2 which is held under pressure by two pairs of pressing rollers 35 and drive rollers 37 which are provided on both sides of the carrier tape 2 is conveyed on a tape conveying path A toward the unloader unit 6 by the rotation of the motors 41.

Meanwhile, the drive rollers 37 of the feed-out section 33 are connected to the rotating shafts of motors (not shown) via one-way clutches (not shown). The motors used in the feed-out section 33 rotate in the opposite direction from the motors 41 used in the pulling section 31. Furthermore, the one-way clutches installed in the feed-out section 33 allow idle rotation of the drive rollers 37 in cases where torque exceeding a specified value in the clockwise direction in FIG. 2(*b*) (i.e., in the conveying direction of the carrier tape 2) is applied to the drive rollers 37.

Accordingly, during operation, the drive rollers 37 of the pulling section 31 and the drive rollers 37 of the feed-out section 33 rotate in opposite directions. However, since the carrier tape 2 is moved in the conveying direction by the action of the one-way clutches of the feed-out section 33, the carrier tape 2 is conveyed while a state of tension is maintained in the direction of length between the pulling section 31 and the feed-out section 33.

Again in FIG. 1 which shows one pair of pressing and drive rollers 35 and 37 of the pulling section 31, the pressing roller 35 is constructed by forming an urethane rubber layer 35*b* on the outer circumference of metal main body 35*a*. A small-diameter portion 51 which is located further toward the center (or to the left in FIG. 1) of the carrier tape 2 with respect to the direction of width of the carrier tape 2, and a large-diameter portion 53 which is located further toward the side edge (or to the right) of the carrier tape 2 are formed on the outer circumference of the urethane rubber layers 35*b*. In other words, the small-diameter portion 51 is located further toward the center (or to the left in FIG. 1) of the tape conveying path 2A, and the large-diameter portion 53 is located further toward the side edge of the tape conveying path 2A. The width of the pressing roller 35 is set at, for instance, 4.0 mm, and the step difference (or a diameter difference) between the small-diameter portion 51 and large-diameter portion 53 is set to be, , for instance, 0.5 mm. Furthermore, the width (W3 in FIG. 3(*b*)) of the outer circumferential surface of the large-diameter portion 53 of the pressing roller 35 is set to be, for instance, 1.5 mm.

Meanwhile, the drive roller 37 is constructed by forming an urethane rubber layer 37*b* on the outer circumference of its metal main body 37*a*. A large-diameter portion 55 (used as a supporting member), which is located further toward the center of the carrier tape 2 with respect to the width of the carrier tape 2, and a small-diameter portion 57, which is located further toward the side edge of the carrier tape 2, are respectively formed on the outer circumference of the urethane rubber layer 37*b*. In other words, the large-diameter portion 55 is located further toward the center of the tape conveying path 2A, and the small-diameter portion is located further toward the side edge of the tape conveying path 2A. The width of the drive roller 37 is set at, for instance, 4.0 mm, and the step difference (or diameter difference) between the large-diameter portion 55 and small-diameter portion 57 is set at,, for instance, 0.3 mm. Furthermore, the width (W1 in FIG. 3(*b*)) of the outer circumferential surface of the large-diameter portion 55 of the drive roller 37 is set at, for instance, 1.5 mm.

As seen from the above, the step difference between the small-diameter portion 57 and large-diameter portion 55 of the drive roller 37 is 0.2 mm smaller than the step difference between the small-diameter portion 51 and large-diameter portion 53 of the pressing roller 35. Accordingly, by installing a pair of pressing roller 35 and drive roller 37 on both sides of the carrier tape 2, as shown in FIG. 3(*c*), the carrier tape 2 is, at its both sides, pressure-held between the large-diameter portions 53 of the pressing rollers 35 and the small-diameter portions 57 of the drive rollers 37; however, the carrier tape 2 is not held by the small-diameter portions 51 of the pressing rollers 35 and the large-diameter portions 55 of the drive rollers 37 because the small-diameter portions 51 and the large-diameter portions 55 are apart from each other by a gap of 0.2 mm when the both sides of the carrier tape 2 are held under pressure (or pressure-held) by the pressing rollers 35 and drive rollers 37.

The carrier tape 2 in the above embodiment is a film-form resin, and it has silicon chips 70 bonded to its undersurface. The width of the carrier tape is, for instance, 35 to 70 mm, and the thickness is, for instance, 0.05 mm.

Next, the operation of the above carrier tape conveying device of the first embodiment will be described.

In FIG. 1 (FIG. 1 shows only one pair of pressing roller 35 and drive roller 37; however, one pair of these rollers (that form a roller assembly) is provided on either side of the tape conveying path 2A, and therefore, the following description will be made with reference to the two pairs of rollers or two roller assemblies provide on either side of the tape conveying path 2A), the outer circumferential surfaces of the large-diameter portions 53 of the pressing rollers 35 and the outer circumferential surfaces of the small-diameter portions 57 of the drive rollers 37 contact each other as a result of the own weight of the pressing frames 39 and downward-oriented driving force as shown by an arrow, and the pressing rollers 35 and drive rollers 37 begin to rotate in opposite directions as a result of the operation of the motors 41.

When the leading edge of (both sides of) the carrier tape 2 is fed between the pressing rollers 35 and drive rollers 37, both side edge portions of the carrier tape 2 are pressure-held by the large-diameter portions 53 of the pressing rollers 35 and the small-diameter portions 57 of the drive rollers 37. As a result, the carrier tape 2 is conveyed toward the unloader unit 6.

This state will be described in further detail with reference to FIGS. 3(*a*) through 3(*c*), using the feed-out section 33 as an example (the same operation is made in the pulling section 31).

First, as shown in FIG. 3(*a*), the outer circumferential surfaces of the large-diameter portions 53 of the pressing rollers 35 contact the side edge portions of the carrier tape 2 carried on the outer circumferential surfaces of the large-diameter portions 55 of the drive rollers 37.

Next, as shown in FIG. 3(*b*), one point on either side edge portion of the carrier tape 2 contacts the shoulder parts A of the small-diameter portions 57 of the drive rollers 37 as the contact points between the pressing rollers 35 and the carrier tape 2 drop. As a result, the side edge portions of the carrier tape 2 are supported by three points, i.e., the shoulder parts A of the small-diameter portions 57 of the drive rollers 37, the shoulder parts C of the large-diameter portions 55 of the drive rollers 37, and the shoulder parts B of the large-diameter portions 53 of the pressing rollers 35. Meanwhile, when the side edge portions of the carrier tape 2 are pressed down, the central portion (the left side in FIG. 3(*b*)) of the carrier tape 2 floats upward from the outer circumferential surfaces of the large-diameter portions 55 of the drive rollers 37 with the shoulder parts C of the large-diameter portions 55 acting as fulcrums.

Next, when the contact points between the pressing rollers 35 and the carrier tape 2 are lowered even further as shown in FIG. 3(*c*), the carrier tape 2 is pushed further downward by the shoulder parts B of the large-diameter portions 53 of the pressing rollers 35. Thus, the carrier tape 2 is held under pressure between the outer circumferential surfaces of the large-diameter portions 53 of the pressing rollers 35 and the outer circumferential surfaces of the small-diameter portions 57 of the drive rollers 37. Furthermore, the carrier tape 2 is elastically deformed into a bent shape along the shoulder parts C of the large-diameter portions 55 of the drive rollers 37, the shoulder parts B of the pressing rollers 35 and the shoulder parts A of the drive rollers 37 against the recovery force of the carrier tape 2. In this case, the carrier tape 2 is deformed from the attitude indicated by the dotted line 59 connecting the shoulder parts A of the pressing rollers 35 and the shoulder parts C of the drive rollers 37 to the attitude indicated by the curved line connecting the parts A, B and C. As a result, the path length between A and C increases, and the carrier tape 2 is pulled toward the side edges (to the right in FIG. 3(*c*)) from the center.

The carrier tape 2 is thus conveyed in an elastically deformed state between the feed-out section 33 and the pulling section 31 as shown in FIG. 3(*c*).

As seen from the above, in the above embodiment, the large-diameter portions 55 of the drive rollers 37 which act as supporting members that protrude upward with respect to the pressure-holding positions of the pressing rollers 35 (acting as second rollers) and drive rollers 37 (acting as first rollers) are installed further toward the center of the carrier tape 2 (with respect to the direction of width of the carrier tape 2) than the pressure-holding positions. Accordingly, the central portion of the carrier tape 2 is lifted in response to the holding of the side edge portions of the carrier tape 2, with the shoulder parts C that constitute the contact points between the carrier tape and the large-diameter portions 55 acting as fulcrums. Furthermore, since the pressing rollers 35 and drive rollers 37 hold the carrier tape 2 while causing elastic deformation of the carrier tape 2, the holding force of the pressing rollers 35 and drive rollers 37 is reinforced by the recovery force of the carrier tape 2. Thus, slipping between the carrier tape 2 and the pressing rollers 35 and drive rollers 37 is prevented.

In the above embodiment, furthermore, when the carrier tape 2 is held by the pressing rollers 35 and drive rollers 37, the carrier tape 2 is deformed from the attitude indicated by the dotted line 59 connecting the shoulder parts A of the pressing rollers 35 and the shoulder parts C of the drive rollers 37 into the attitude indicated by the curve formed by the parts A, B and C. Accordingly, the path length between A and C increases, and the carrier tape 2 is pulled toward the side edges from the central portion of the carrier tape 2, thus causing considerable tension to be applied to the central portion of the carrier tape 2. Accordingly, as a result of these actions, sagging of the central portion of the carrier tape 2 can be prevented in advance.

Furthermore, the pressing rollers 35 and drive rollers 37 merely cause elastic deformation of the carrier tape 2, and they do not cause any plastic deformation of the carrier tape 2. Accordingly, after passing through the pressure-holding position of the rollers, the carrier tape 2 is restored to its original flat shape. Consequently, the dimensions of the carrier tape 2 in the direction of width and direction of thickness can always be maintained at constant values, and there is no loss of conveying precision or working precision.

Furthermore, the carrier tape 2 is conveyed while a state of tension is maintained in the direction of length between the pulling section 31 and the feed-out section 33. Accordingly, there may be cases in which waviness or warping is generated in the carrier tape 2 in the direction of width as a result of local stretching along the direction of length of the carrier tape 2. In the above-described embodiment, since the large-diameter portions 55 of the drive rollers 37 (which act as supporting members that protrude upward with respect to the pressure-holding positions) are disposed further toward the center of the carrier tape 2 (with respect to the direction of width of the carrier tape 2) than the pressure-holding positions, the central portion of the carrier tape 2 is constantly lifted upward. Accordingly, sagging in the direction of width can be prevented.

Furthermore, in the above embodiment, the widths of the pressing rollers 35 and drive rollers 37 are both set at 4.0 mm, and the widths W3 and W1 of the outer circumferential surfaces of the large-diameter portions 53 of the pressing rollers 35 and the outer circumferential surfaces of the large-diameter portions 55 of the drive rollers 37 are both equally set at 1.5 mm.

However, instead of such a construction, the width W3 of the outer circumferential surfaces of the large-diameter portions 53 of the pressing rollers 35 can be set to, for instance, 2.0 mm, and the width W1 of the outer circumferential surfaces of the large-diameter portions 55 of the drive rollers 37 can be set to, for instance, 1.0 mm. As a result, the width W3 of the outer circumferential surfaces of the large-diameter portions 53 of the pressing rollers 35 is larger than the width W1 of the outer circumferential surfaces of the large-diameter portions 55 of the drive rollers 37. In this case, the contact area of the outer circumferential surfaces of the large-diameter portions 53 of the pressing rollers 35 with respect to the carrier tape 2 is larger than the contact area of the outer circumferential surfaces of the large-diameter portions 55 of the drive rollers 37. Accordingly, when the carrier tape 2 is pressure-held by both sets of rollers, the carrier tape 2 conforms well to the outer circumferential surfaces of the large-diameter portions 53 of the pressing rollers 35, so that the carrier tape 2 is strongly held and elastically deformed. Consequently, sagging of the carrier tape 2 in the direction of width can be prevented even more effectively.

Furthermore, in order to obtain the same result, it is also possible to form the outer circumferential surfaces of the large-diameter portions 55 of the drive rollers 37 as smooth surfaces, and to form the outer circumferential surfaces of the large-diameter portions 53 of the pressing rollers 35 as rough surfaces. Moreover, it is also possible to form the outer circumferential surfaces of the small-diameter portions 57 of the drive rollers 37 as rough surfaces. Rounding of the shoulder parts B of the outer circumferential surfaces of the large-diameter portions 53 of the pressing rollers 35 is also appropriate.

In the above embodiment, the widths W3 and W1 of the outer circumferential surfaces of the large-diameter portions 53 of the pressing rollers 35 and the outer circumferential surfaces of the large-diameter portions 55 of the drive rollers 37 are both set to be 1.5 mm. As a result, the spacing W2 of the shoulder parts B of the large-diameter portions 53 of the pressing rollers 35 and the shoulder parts C of the outer circumferential surfaces of the large-diameter portions 55 of the drive rollers 37 in the axial direction is 1.0 mm. However, this spacing W2 of B and C in the axial direction may be altered in accordance with the thickness of the carrier tape 2. For instance, if this spacing W2 of B and C in the axial direction is set at a larger value for a thick carrier tape 2, plastic deformation of such a carrier tape 2 can be prevented.

In addition, in the first embodiment, the drive rollers 37 are installed on the driving side, and the pressing rollers 35 are installed on the following side. However, it is also possible to install driving motors on the pressing rollers 35 and install the drive rollers 37 as following rollers.

Furthermore, in the above embodiment, the large-diameter portions 55 are formed integral to the drive rollers 37. Instead, it is possible to construct supporting members as separate components from the drive rollers 37. For example, it is possible to form these supporting members as guide arms or separate rollers that protrude upward in positions located further toward the center of the carrier tape 2 than the drive rollers 37. However, in the shown embodiment, since the large-diameter portions 55 which act as supporting members are formed as integral parts of the drive rollers 37, the structure is simpler than in cases where the drive rollers 37 and supporting members are constructed as separate parts. Furthermore, such a structure of the shown embodiment is also advantageous in that the difference in height positions between the pressure-holding positions of the side edge portions of the carrier tape 2 (i.e., the outer circumferential surfaces of the small-diameter portions 57) and the holding positions of the central portion of the carrier tape 2 (i.e., the outer circumferential surfaces of the large-diameter portions 55) can be accurately maintained regardless of the assembly precision of the drive rollers 37.

Furthermore, in the above embodiment, the large-diameter portions 55 are formed on the drive rollers 37. However, the shape of the roller used in the present invention is not limited to such a structure. Various other modifications are possible as long as the supporting members that protrude upward are disposed further toward the inside of the carrier tape 2 in the direction of width than the pressure-holding positions so that the carrier tape 2 can be held while being caused to undergo elastic deformation. Such various modifications are shown in FIGS. 4(*a*) through 4(*f*). In the structure of FIG. 4(*a*), a large-diameter portion is formed on the roller provided above the side-edge of the carrier tape 2; and the respective shoulder portions can be rounded as shown in FIG. 4(*b*). Inclined surfaces can be formed between the large-diameter portions and small-diameter portions of the rollers as shown in FIG. 4(*c*), or the outer circumferential surfaces of the rollers can be formed as inclined surfaces as shown in FIG. 4(*d*). Moreover, it is also possible to set the shafts of the upper and lower rollers inclined with respect to the horizontal direction as shown in FIGS. 4(*e*) and 4(*f*).

Next, another embodiment of the present invention will be described with reference to FIGS. 5(*a*) and 5(*b*). The tape conveying device of this embodiment is especially suitable for use in cases where a carrier tape in which an outer layer that has a certain thickness such as a copper foil layer, etc. is formed on a portion of at least one surface of the carrier tape is used.

More specifically, the carrier tape 62 shown in FIG. 5(*a*) has a copper foil layer 63 formed as an outer layer on the undersurface of an inner layer 64 that is a film-form resin, with the side edge portions of the inner layer 64 left exposed with no copper foil layer formed thereon. The portions of the undersurface of the inner layer 64 on which the copper foil layer 63 is not formed are called "exposed portions 65." Silicon chips (not shown) are bonded to the central portion of the copper foil layer 63 with respect to the direction of width of the layer (or the tape). The width of the carrier tape is, for instance, 35 mm, the thickness of the inner layer 64 is, for instance, 0.05 mm, and the thickness of the outer layer 63 is, for instance, 0.02 mm.

In the embodiment shown in FIGS. 5(*a*) and 5(*b*), the drive rollers 67 that have flat outer circumferential surfaces are used as the first rollers instead of the drive rollers 37 with large-diameter portions 55 and small-diameter portions 57 used in the above-described embodiment shown in FIGS. 3(*a*) to 3(*c*).

In FIG. 5(*a*), the outer circumferential surfaces (shown as the upper end) of the drive rollers 67 face an area that covers both the copper foil layer 63 and the exposed portions 65 of the inner layer 64 of the carrier tape 62. Meanwhile, the pressing rollers 75 that are second rollers have large-diameter portions 73, and the outer circumferential surfaces of these large-diameter portions 73 face the upper surfaces of the exposed portions 65 of the inner layer 64 of the carrier tape 62. The remaining constituting elements of the embodiment of FIGS. 5(*a*) and 5(*b*) are the same as those of the device of the above-described embodiment. Accordingly, a description of these elements is omitted here.

Next, the operation of the carrier tape conveying device of the embodiment shown in FIGS. 5(*a*) and 5(*b*) will be described.

In FIG. 5(*a*), when the leading edge of the carrier tape 62 is fed between the pressing rollers 75 and drive rollers 67 rotating in opposite directions, both side edge portions of the carrier tape 62 are held under pressure by the large-diameter portions 73 of the pressing rollers 75 and the outer circumferential surfaces of the drive rollers 67 as shown in FIG. 5(*b*); and the carrier tape 62 is conveyed.

More specifically, the outer circumferential surfaces of the large-diameter portions 73 of the pressing rollers 75 first contact the side edge portions of the carrier tape 62 carried on the outer circumferential surfaces of the drive rollers 67 as shown in FIG. 5(*a*).

Next, as shown in FIG. 5(*b*), one point of either side portion of the carrier tape 62 contacts the shoulder parts A of the drive rollers 67 as the contact points between the pressing rollers 75 and carrier tape 62 drop. Furthermore, the carrier tape 62 is pushed further downward by the shoulder parts B of the large-diameter portions 73 of the pressing rollers 75, so that the exposed portions 65 of the inner layer 64 where no copper foil layer 63 is formed on the side edge portions of the carrier tape 62 are pressure-held between the outer circumferential surfaces of the large-diameter portions 73 of the pressing rollers 75 and the outer circumferential surfaces of the drive rollers 67. The carrier tape 62 is elastically deformed into a bent shape along the side edges E of the copper foil layer 63, the shoulder parts B of the pressing rollers 75 and the shoulder parts A of the drive rollers 67 against the recovery force of the carrier tape 62. As a result, the surfaces of both the copper foil layer 63 and the exposed portions 65 of the inner layer 64 are maintained at equal height positions along the outer circumferential surfaces of the drive rollers 67. Meanwhile, as the side edge portions of the carrier tape 62 are lowered, the central portion of the carrier tape 62 floats upward from the outer circumferential surfaces of the drive rollers 67 with the side edges E of the copper foil layer 63 acting as fulcrums.

As seen from the above, in the embodiment of FIGS. 5(*a*) and 5(*b*), the thickness of the copper foil layer 63 formed on one side of the carrier tape 62 is utilized as a spacer. As a result, the central portion of the carrier tape 62 is lifted, and the holding force of the pressing rollers 75 and drive rollers 67 is reinforced by the recovery force of the carrier tape 62. Thus, an effect which prevents sagging of the carrier tape 62 can be obtained. Furthermore, since the surfaces of both the copper foil layer 63 and the exposed portions 65 of the inner layer 64 are maintained at the same height position along the outer circumferential surfaces of the drive rollers 67, the exposed portions 65 of the inner layer 64 show good adhesion to the pressing rollers 75 and drive rollers 67. As a result, the carrier tape 62 can be firmly pressure-held, and sagging of the central portion of the carrier tape 62 caused by the slipping of the carrier tape 62 from the pressing roller 75 and drive rollers 67 can be effectively prevented.

Furthermore, in the embodiment of FIGS. 5(*a*) and 5(*b*), the pressing rollers 75 and drive rollers 67 pressure-holds only the exposed portions 65 of the inner layer 64 of the carrier tape 62 (where no copper foil layer 63 is formed). Accordingly, even if local stretching in the direction of length of the carrier tape 62 should occur in the portions of the carrier tape 62 located in the vicinity of the pressing rollers 75 and drive rollers 67, such stretching will act only on the exposed portions 65 of the inner layer 64 where no copper foil layer 63 is formed. Thus, the central portion of the tape 62 where the copper foil layer 63 is formed is prevented from being deformed.

Furthermore, in the above embodiment, the carrier tape 62 has the copper foil layer 63 formed as an outer layer over the entire surface of the inner layer 64 except for the side edge portions of the inner layer 64. However, the embodiment of FIGS. 5(*a*) and 5(*b*) is applicable to any carrier tape that has an outer layer which is thick enough to act as a spacer and is formed on the central portion of the carrier tape with the side edge portions of the inner layer left exposed. For example, the embodiment can effectively convey a carrier tape that has an outer layer in the direction of length of the tape only in areas that face the outer circumferential surface of a drive roller. Furthermore, in the embodiment of FIGS. 5(*a*) and 5(*b*), the carrier tape 62 has the copper foil layer formed as an outer layer on the surface of only one side of the carrier tape 62. However, the device of the embodiment of FIGS. 5(*a*) and 5(*b*) can convey the tape in which outer layers are formed on both (top and bottom) surfaces thereof In the respective embodiments described above, carrier tapes 2 and 62 are made of a synthetic resin. However, as long as the carrier tape is a flexible band-form carrier member, the present invention is applicable thereto; and the tape can be made of some other material such as a metal sheet.

Furthermore, in the respective embodiments described above, a wire bonder used for semiconductor element assembly is described as an example of an electronic component assembling device 1. However, the present invention can also be applied to other semiconductor element assembly devices such as die bonders used for semiconductor element assembly in which silicon chips are bonded to a carrier tape, as well as other electronic component assembling devices that utilize carrier tapes.

What is claimed is:

1. A device for conveying a carrier tape used for an electronic component wherein a side edge portion of a carrier tape is pressure-held from upper and under surfaces thereof by a pair of rollers rotating in opposite directions so as to convey said carrier tape in a direction of length of said carrier tape, said device being characterized in that:

a supporting member which protrudes upward with respect to a pressure-holding position of each one of said pairs of rollers is installed further toward a center of said carrier tape with respect to a direction of width of said carrier tape than said pressure-holding position of said pair of rollers, so that said carrier tape is held by said pair of rollers and said supporting member while being elastically deformed in a manner that allows recovery from said deformation.

2. The conveying device according to claim 1, wherein said pair of rollers is comprised of a first roller and a second roller, said first roller has a large-diameter portion which is formed thereon and located further toward a center of said carrier tape with respect to a direction of width of said carrier tape, and a small-diameter portion which is formed on said first roller and is located further toward a side edge of said carrier tape, an outer circumferential surface of a large-diameter portion formed on said second roller faces an outer circumferential surface of said small-diameter portion of said first roller, and said large-diameter portion of said first roller constitutes said supporting member.

3. The device according to claim 2, wherein a width of an outer circumferential surface of said large-diameter portion of said second roller is equal to or greater than a width of said outer circumferential surface of said large-diameter portion of said first roller.

4. The device for conveying a carrier tape according to any one of claims 1 through 3, wherein said pairs of rollers are installed on one side of a working head which is used to perform a specific work on said carrier tape, said pairs of rollers are caused to undergo opposite rotation in a direction that said carrier tape pressure-held by said pairs of rollers is caused to move away from said working head, and a resistance means which holds said carrier tape against a moving force of said pairs of rollers is installed on another side of said working head.

5. A device for conveying a carrier tape used for an electronic component in which a carrier tape on a tape conveying path is conveyed in a direction of length of said carrier tape by a roller assembly provided on either side of said tape conveying path, wherein said roller assembly is comprised of a lower roller and an upper roller;

said lower roller is provided with a large-diameter portion and a small-diameter portion, said large-diameter portion being formed further toward a center of said tape conveying path, and said small-diameter portion being formed further toward a side edge of said tape conveying path; and said upper roller is urged toward said lower roller and is provided with a small-diameter portion and a large-diameter portion, said small-diameter portion being formed further toward said center of said tape conveying path and said large-diameter portion being formed further toward said side edge of said tape conveying path; and wherein an outer circumferential surface of said large diameter portion of said lower roller faces an outer circumferential surface of said small-diameter portion of said upper roller, and an outer circumferential surface of said large diameter portion of said upper roller faces an outer circumferential surface of said small-diameter portion of said lower roller, thus conveying said carrier tape by rotatating said lower roller with a side edge of said carrier tape being pressure-held between said outer circumferential surface of said large diameter portion of said upper roller and said outer circumferential surface of said small-diameter portion of said lower roller.

* * * * *

UNITED STATES PATENT AND TRADEMARK OFFICE

CERTIFICATE OF CORRECTION

PATENT NO. : 6,419,138 B1
DATED : July 16, 2002
INVENTOR(S) : Koichi Takahashi et al.

It is certified that error appears in the above-identified patent and that said Letters Patent is hereby corrected as shown below:

Title page, Item [54] and Column 1, line 1,
Title, change "DEVICE CONVEYING A CARRIER TAPE USED FOR ELECTRONIC COMPONENTS" to -- DEVICE FOR CONVEYING A CARRIER TAPE USED FOR ELECTRONIC COMPONENTS --

Signed and Sealed this

Tenth Day of August, 2004

JON W. DUDAS
*Acting Director of the United States Patent and Trademark Office*